United States Patent [19]

Makihara et al.

[11] Patent Number: 4,927,392

[45] Date of Patent: May 22, 1990

[54] AIR SUPPLY APPARATUS FOR OUTBOARD MOTOR

[75] Inventors: Nobuo Makihara; Hideo Tahara, both of Yokosuka, Japan

[73] Assignee: Nissan Motor Co., Ltd., Kanagawa, Japan

[21] Appl. No.: 322,199

[22] Filed: Mar. 13, 1989

[30] Foreign Application Priority Data

Mar. 15, 1988 [JP] Japan ..... 63-33817[U]

[51] Int. Cl.[5] ..... B63H 21/36

[52] U.S. Cl. ..... 440/88; 440/77

[58] Field of Search ..... 440/112, 49, 111, 88, 440/89, 76, 900, 77, 53–66; 277/30; 123/195 R, 195 C, 195 P; 285/226, 223

[56] References Cited

U.S. PATENT DOCUMENTS

| | | | |
|---|---|---|---|
| 1,511,867 | 10/1924 | Asbury | 440/55 |
| 3,487,804 | 1/1970 | Kiekhaefer | 440/76 |
| 4,371,348 | 2/1983 | Blanchard | 440/88 |
| 4,395,238 | 7/1983 | Payne | 440/53 |
| 4,623,313 | 11/1986 | Ferguson | 440/112 |

*Primary Examiner*—Joseph F. Peters, Jr.
*Assistant Examiner*—Clifford T. Bartz
*Attorney, Agent, or Firm*—Foley & Lardner, Schwartz, Jeffery, Schwaab, Mack, Blumenthal & Evans

[57] ABSTRACT

A flexible duct is connected between the outboard motor and the hull transom, to supply air, fuel, power and control cables to the motor liftably and steerably attached to the transom, even when the motor sinks into water. To improve the durability of the flexible duct, that is, to allow the flexible duct not to be moved whenever the outboard motor is pivoted for steering operation, the air supply apparatus for an outboard motor comprises (a) a hollow steering shaft pipe fixedly supported near the transom; (b) upper and lower bearings, attached between the steering shaft pipe, for supporting the pivotal steering shaft of the motor; (c) a cylindrical cover for pivotably and slidably covering the upper end of the steering shaft pipe; and (d) a flexible duct connected between the transom and the fixed hollow steering shaft pipe.

9 Claims, 7 Drawing Sheets

AIR SUPPLY APPARATUS FOR OUTBOARD MOTOR

BACKGROUND OF THE INVENTION

1. Field of the Invention

The present invention relates to an air supply apparatus for an outboard motor, and more specifically to an apparatus for supplying air, fuel, power and control cables to the outboard motor (a small gasoline engine provided with a marine propulsion unit) liftably and steerably attached to a transom of a motorboat hull, even when the outboard motor sinks into water.

2. Description of the Prior Art

An example of prior-art air supply apparatus for outboard motors is disclosed in U.S. Pat. No. 4,375,356 entitled ARRANGEMENT FOR SUPPLYING AIR, FUEL, POWER AND CONTROL CABLES TO A. MARINE PROPULSION UNIT by Stevens. FIGS. 1(A) and (B) show a Stevens' outboard motor. In these drawings, an outboard motor 9 is formed with a sealed power head (engine) compartment 5 and an engine cover 6 having a forwardly located cover wall 8, and composed of an internal combustion engine 9A, and a propulsion unit 9B having a propeller drive shaft 9C, a reversing transmission 9D and a propeller 9E. Further, the motor 9 is liftably and steerably attached to a transom 2 of a boat hull 1 via a mounting unit lA in such a way that the engine 9A communicates with the inside of the boat hull 1 through a flexible boot or duct 3 watertightly fixed between an aperture 4 formed in the transom 2 and an aperture 7 formed in the engine cover 6, as depicted in FIG. 1(B). Further, in FIG. 1(A), 1B denotes a swivel bracket and 1C denoted a steering axis.

In the above-mentioned prior-art air supply apparatus for an outboard motor, however, since the duct 3 is directly connected between the aperture 4 of the transom 2 and that 7 of the engine cover 6, when the duct 3 is connected to the engine cover 6 at a position away from the steering axis lC of the outboard motor 9, the duct 3 is moved together with the engine cover 6 whenever the propulsion unit 9B is pivoted for steering operation, thus resulting in a problem in that the durability of the duct 3 is poor. Further, even if the duct 3 is attached to the upper surface of the engine cover 6 at the steering axis 1C, there still exist a problem in that the duct is twisted whenever the propulsion unit 9B is pivoted for steering operation, so that the duct durability is still not satisfactory and further the external appearance is not good because the duct can easily be seen from outside.

SUMMARY OF THE INVENTION

With these problems in mind, therefore, it is the primary object of the present invention to provide an air supply apparatus for an outboard motor excellent in both durability and external appearance without being subjected to the influence of pivotal steering motion of the propulsion unit or the outboard motor.

To achieve the above-mentioned object, an air supply apparatus for an outboard motor provided with an engine compartment (5) and a steering shaft (15) and movably supported near a transom (2) of a boat hull (1), according to the present invention comprises: (a) a hollow steering shaft pipe (12) fixedly supported near the transom and formed with an inner hollow portion (16); (b) upper and lower bearings (13, 14), attached between upper and lower ends of said hollow steering shaft pipe, for pivotally supporting the steering shaft of the outboard motor; (c) a cylindrical cover (19, 31), attached to a bottom surface of the engine compartment coaxially with said hollow steering shaft pipe, for pivotally and slidably covering an upper side of said hollow steering shaft pipe so that the inner hollow portion of said hollow steering shaft pipe communicates with the engine compartment; and (d) a flexible duct (25), connected between said hollow steering shaft pipe and the transom, for introducing air from inside the hull to the engine compartment through said flexible duct, said hollow steering shaft pipe and said cylindrical cover.

The inner hollow portion communicates with the engine compartment through at least one opening (17) formed in the upper bearing or at least one aperture (30) formed in the upper side surface of the hollow steering shaft pipe.

In the air supply apparatus for an outboard motor according to the present invention, since the outboard motor can be pivoted about the fixed hollow steering shaft pipe and the flexible duct is connected between this fixed hollow steering shaft pipe and the hull transom in such a way that the hollow steering shaft pipe is usable as an air supply passage, the flexible duct is not moved during steering operation, thus improving the duct durability. Further, since the duct is arranged between the outboard motor and the hull transom and below the engine compartment, it is possible to improve the external appearance of the outboard motor.

DETAILED DESCRIPTION OF THE PREFERRED EMBODIMENTS

Figure 1A:
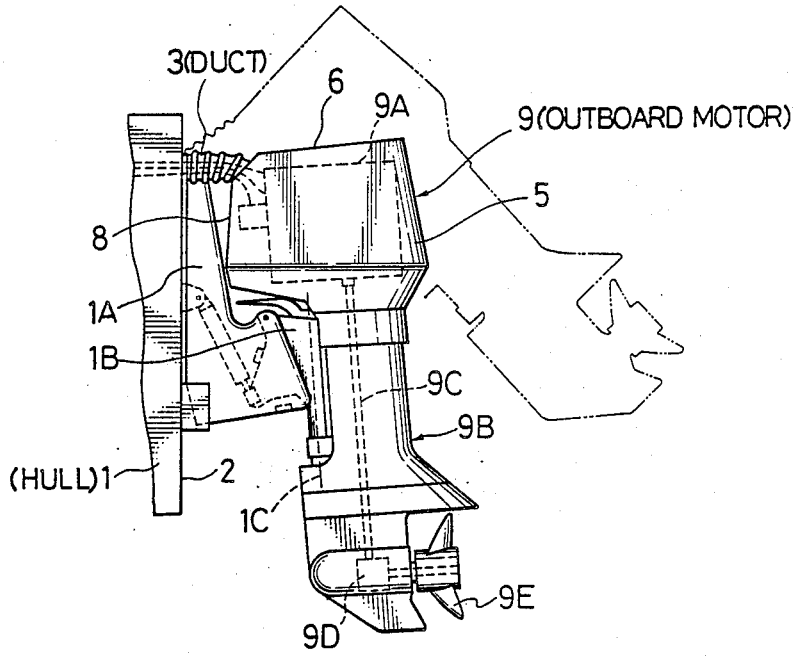
FIG.1(A) PRIOR ART
FIG. 1(A) is a side view showing an example of prior-art air supply apparatus for an outboard motor.
Figure 1B:
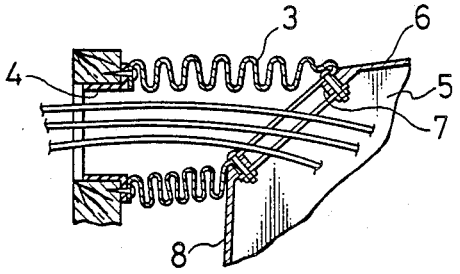
FIG.1(B) PRIOR ART
FIG. 1(B) is an enlarged cross-sectional view showing a duct of the prior-art air supply apparatus shown in FIG. 1(A)

An air supply apparatus of the present invention will be described hereinbelow with reference to the attached drawings.

An outboard motor 9 is supported by a motor support device 10 attached to a transom 2 of a boat hull 1. The motor support device 10 includes a U-shaped support plates 28 fixed to the transom 2, two guide rollers 28A fixed to the support plates 28, respectively, a hollow steering shaft pipe 12, two lift plates 11 fixed to the steering shaft pipe 12 and supported by the two guide rollers 28A engaged with two slots 11A formed in the lift plates 11, respectively, and a piston rods 26 connected between the steering shaft pipe 12 and the support plate 28 and a piston rod 27 attached to the transom 2. Further, a steering shaft 15 of the outboard motor 9 is pivotally supported by two upper and lower bearings 13 and 14 fixed to both upper and lower ends of the steering shaft pipe 12, and further a cylindrical cover 19 formed with a flange 22 fixed to a bottom surface of an engine compartment 5 of the motor 9 is coaxially fitted to the upper end portion of the hollow steering shaft pipe 12.

Figure 4:
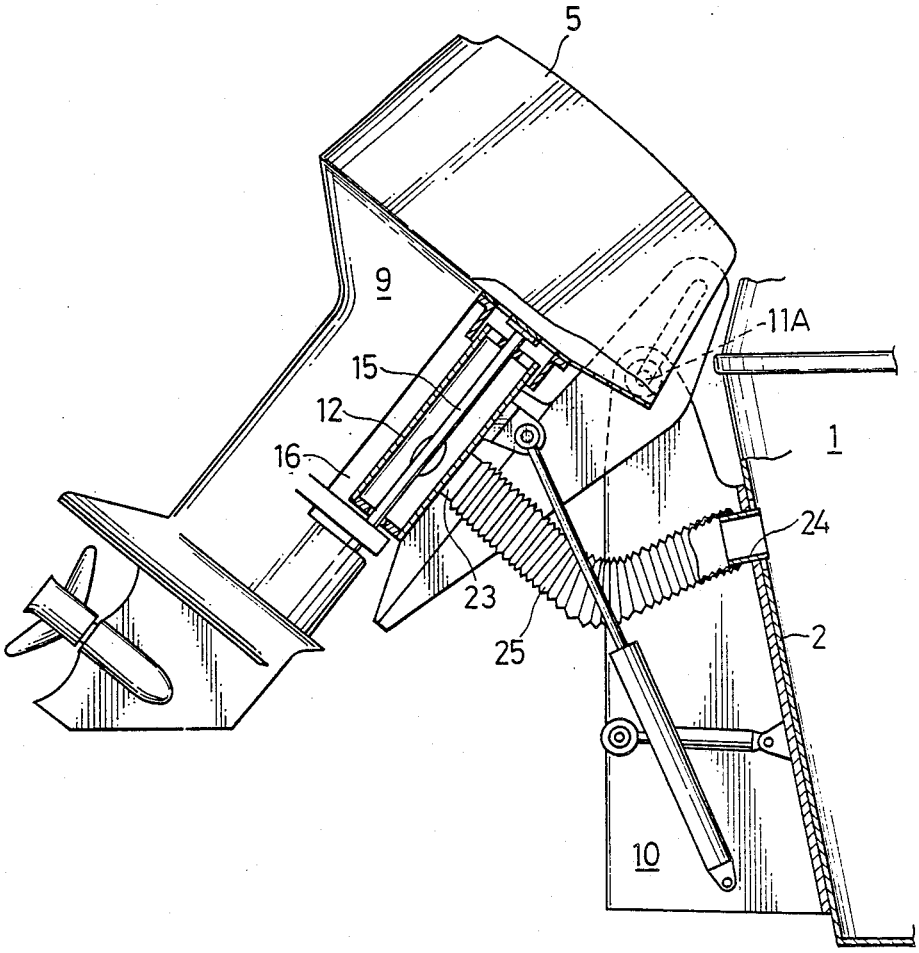
FIG. 4 is a side, partially cross-sectional view showing the first embodiment shown in FIG. 2 when the outboard motor is lifted and tilted upward at anchor, for instance.

Therefore, when piston rod 26 is actuated, steering shaft pipe 12 (outboard motor 9) can be pivoted upward to a tilted position, as shown in FIG. 4, about the two guide rollers 28A. In this specification, "tilt" implies that the motor 9 is tilted at anchor; "lift" implies that the motor 9 is moved upward vertically; "kick-up" implies that motor 9 is moved upward when brought into contact with driftwood; and "steer" implies that the motor 9 is pivoted for steering motion.

Figure 2:
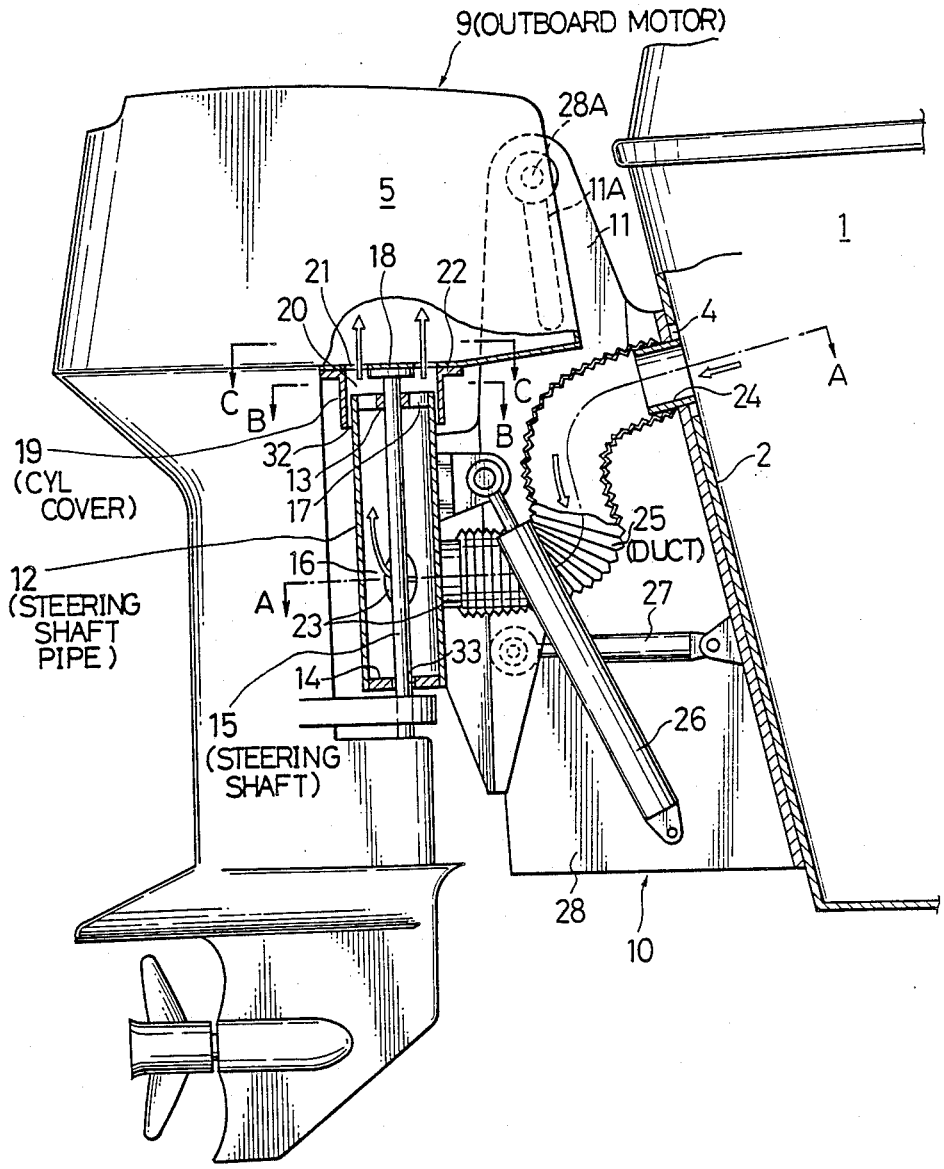
FIG. 2 is a side, partially cross-sectional view showing a first embodiment of the air supply apparatus for an outboard motor according to the present invention.

In FIG. 2 since the inner diameter of the steering shaft pipe 12 is designed larger than the outer diameter of the steering shaft 15, a cylindrical hollow passage 16 can be formed inside the steering shaft pipe 12 for supplying air from inside the hull to the engine compartment 5.

Figure 3:
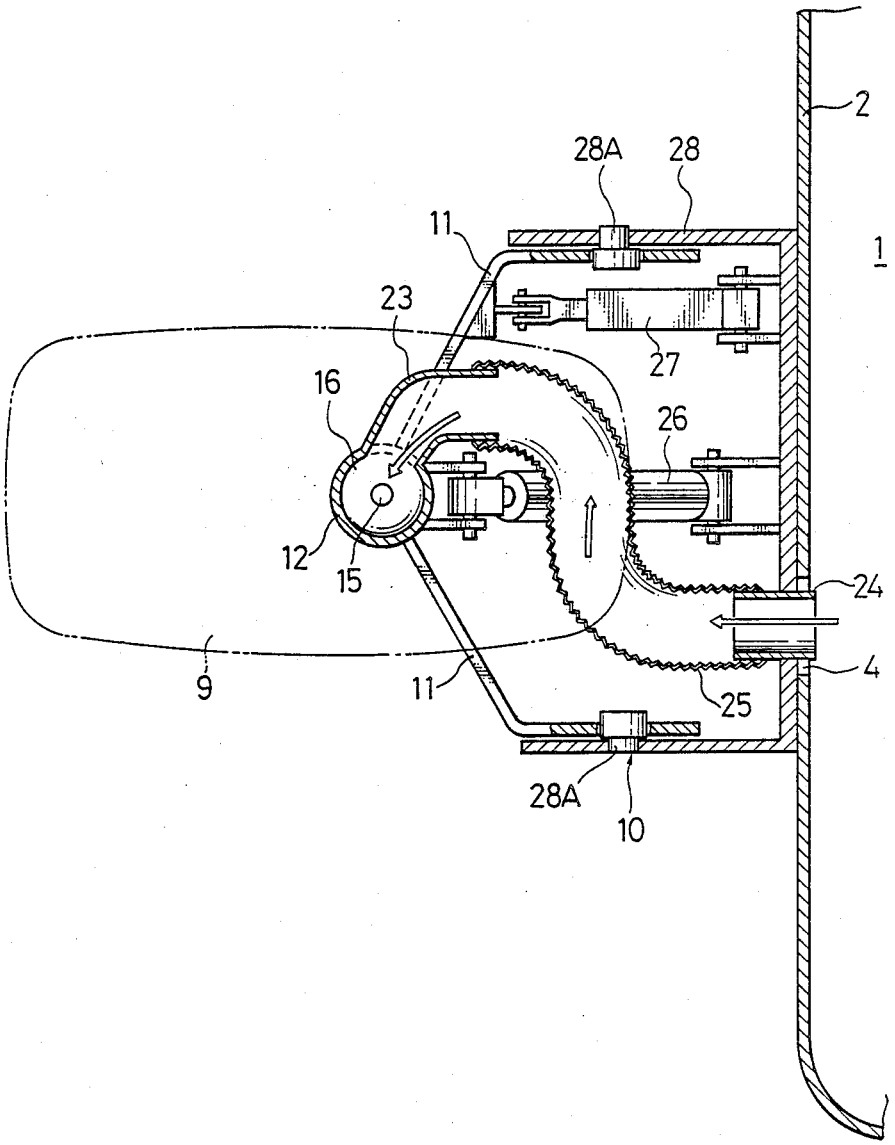
FIG. 3(A) is a top or roughly top view when seen from above the line A—A shown in FIG. 2.
FIG. 3(B) is an enlarged top view showing an upper bearing, when seen from above the line B—B shown in FIG. 2.
FIG. 3(C) is an enlarged top view showing a bottom surface of an engine compartment together with the bearing, when seen from above the line C—C shown in FIG. 2 under the condition that the outboard motor is not steered
FIG. 3(D) is an enlarged top view showing the bottom surface of the engine compartment together with the bearing, when seen from above the line C—C shown in FIG. 2 under the condition that the outboard motor is steered by 60 degrees from the central position.
Figure 3B:
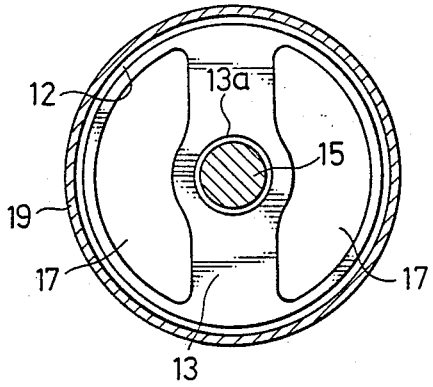

As shown in FIGS. 2 and 3(B), the upper bearing 13 is fitted to the inner upper end of the steering shaft pipe 12. The upper bearing 13 is formed with an arm portion (at the center of which a bearing member 13*a* is provided so that the steering shaft 15 can freely be pivoted) and two roughly semicircular openings 17. Also, as described already, the cylindrical cover 19 fixed to the bottom surface 18 of the engine compartment 5 is pivotally fitted to the outer upper end of the steering shaft pipe 12, in such a way that an upper air communication passage 20 can be formed so as to be protected from air and water within this cylindrical cover 19 (in FIG. 2, a space between the steering shaft pipe 12 and the cylindrical cover 19 is shown exaggeratedly to indicate a gap 32).

Figure 3C:
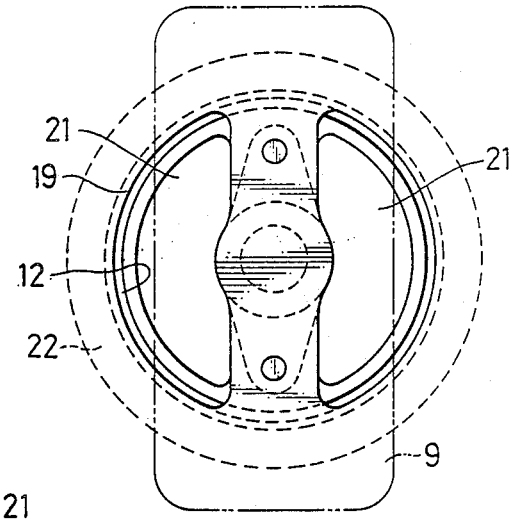
Figure 3D:
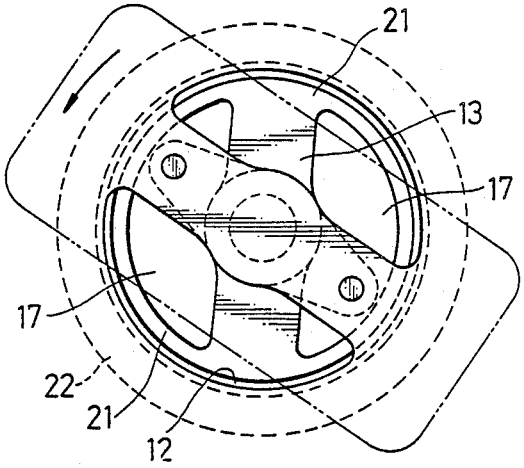

As shown in FIGS. 3(C) and (D), the bottom surface 18 of the engine compartment 5 is formed with two roughly semicircular openings 21, so as to full communicate with the two roughly semicircular openings 17 of the upper bearing 13 when the motor 9 is not steered at the central steering position (FIG. 3(C)) but partially communicated with the two openings 17 of the upper bearing 13 when the motor 9 is steered toward the left by 60 degrees from the central steering position (FIG. 3(D)).

With reference to FIG. 3(A), an angled connection pipe 23 is connected to the side surface of the steering shaft pipe 12 so as to communicate with the inner space 16 of the steering shaft pipe 12. On the other hand, a straight connection pipe 24 is connected to an aperture 4 formed in the transom 2. A flexible and expansible duct 25 is connected between the angled connection pipe 23 and the straight connection pipe 24 so as to provide a sufficient sag (loosening) as depicted in FIG. 3(A) under protection from air and water.

Therefore, air within the boat hull 1 can be introduced into the engine compartment 5 by way of the straight connection pipe 24, the flexible duct 25, the angled connection pipe 23, the steering shaft pipe 12, the openings 17 of the upper bearing 13, and the openings 21 of the bottom surface 18 of the engine compartment 5.

Figure 5:
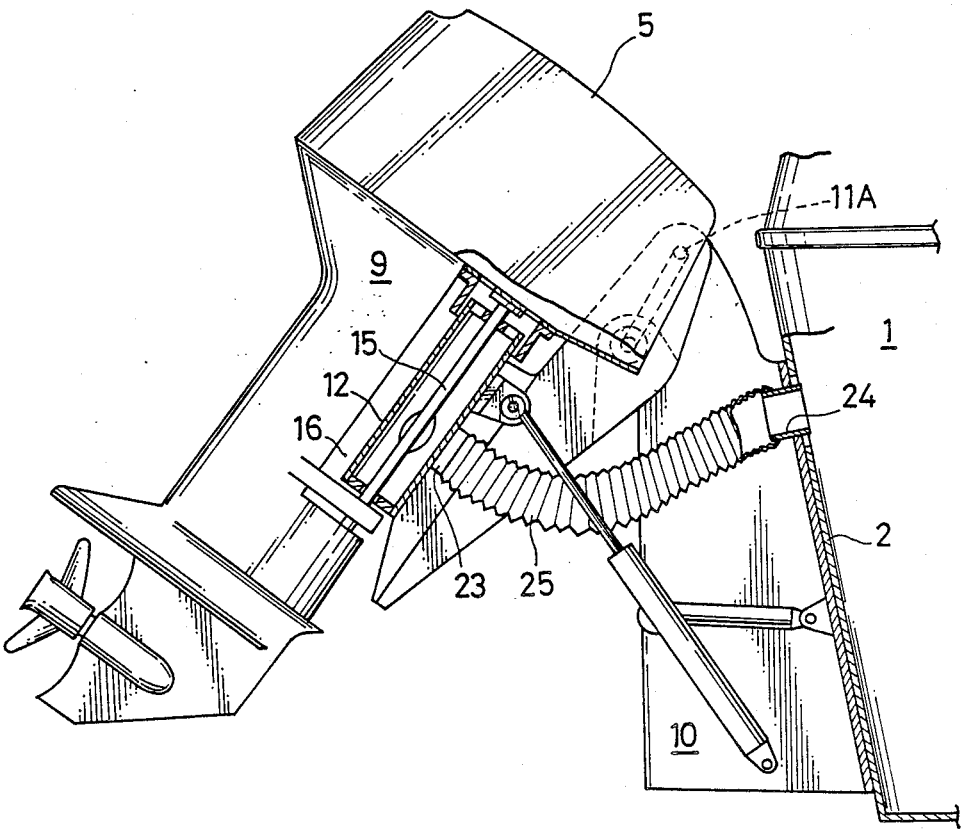
FIG. 5 is a side, partially cross-sectional view showing the first embodiment, shown in FIG. 2 when the outboard motor is moved upward by driftwood to a kick-up position.

In the air supply apparatus of the present invention, even when the outboard motor 9 including the engine compartment 5 is pivoted about the steering shaft 15 or the steering shaft pipe 12 for steering operation, the flexible duct 25 is not moved, because the steering shaft pipe 12 and the angled connection pipe 23 are both fixed to the lift plates 11 supported to the motor support device 10. Further, although the flexible duct 25 is expanded when the outboard motor 9 is moved upward (lifted and tilted) as shown in FIG. 4 or when the outboard motor 9 is moved very rarely by driftwood to a kick-up position as shown in FIG. 5, since this chance is not so often as compared with the steering operation, it is possible to markedly improve the durability of the flexible duct 25 or to reduce the possibility of duct damage due to bending fatigue, as compared the prior-art apparatus as shown in FIGS. 1(A) and (B).

By the way, although outboard motor 9 sometimes sinks into water and therefore there exists such a possibility that water enters the hollow portion 16 of steering shaft pipe 12 through the gap 32 formed between the steering shaft pipe 12 and the cylindrical cover 19 and the gap 33 formed between the steering shaft 15 and the lower bearing 14, since gaps 32 and 33 are small, the amount of water coming into the steering shaft pipe 12 is small. Further, even if water enters steering shaft pipe 12, the water flows to the outside through the lower gap 33 whenever the water level is lower than the lower bearing 14. Therefore, water within the steering shaft pipe 12 will not flow into the flexible duct 25 and the engine compartment 5.

Figure 6:
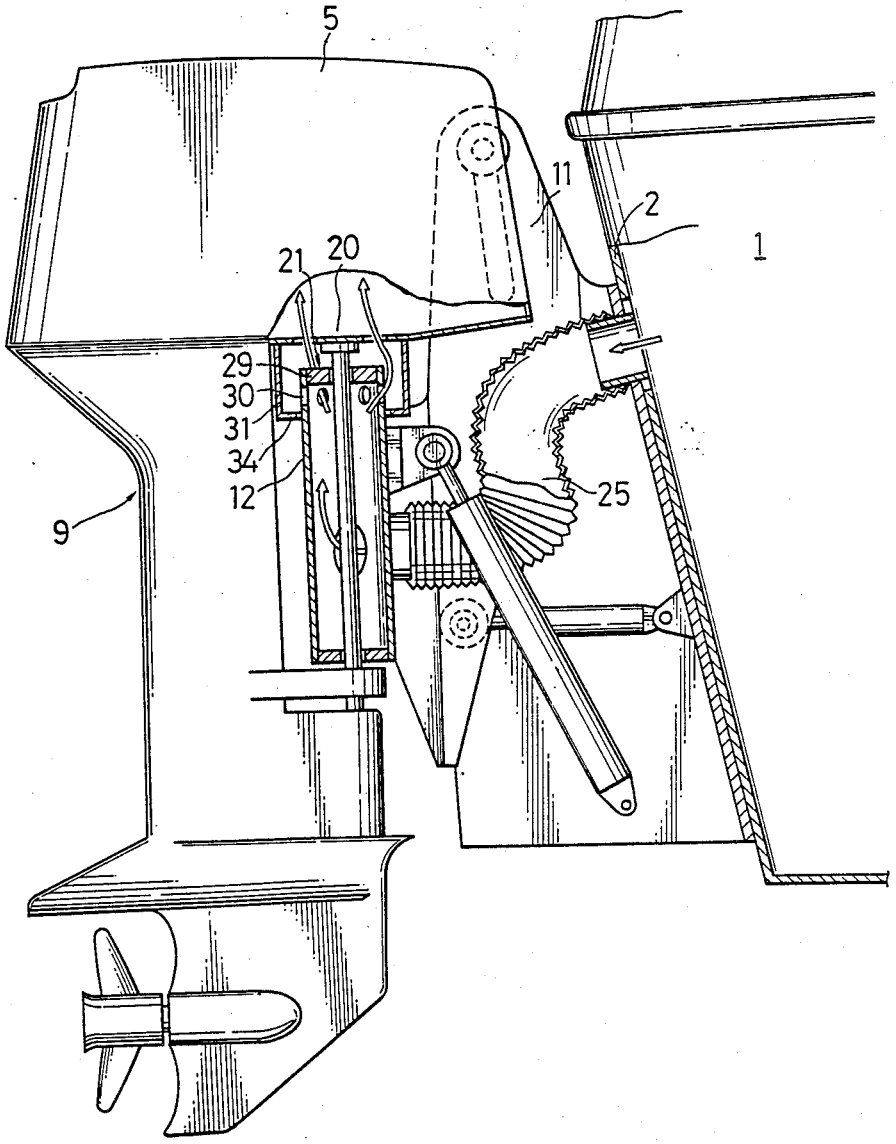
FIG. 6 is a side, partially cross-sectional view showing a second embodiment of the air supply apparatus for an outboard motor according to the present invention.

FIG. 6 shows a second embodiment, in which an upper bearing 29 formed with no openings is fitted to the upper end portion of the steering shaft pipe 12 and instead a plurality of apertures 30 are formed at the upper side surface of the steering shaft pipe 12. Further, there is disposed a cylindrical cover 31 formed with an inner flange portion 34 whose inner diameter is larger than the outer diameter of the steering shaft pipe 12.

In the first embodiment shown in FIG. 2, the area of the openings 17 of the upper bearing 13 is reduced whenever the outboard motor 9 is pivoted for steering operation, as shown in FIG. 3(D). In this second embodiment shown in FIG. 5, the area of the apertures 30 will not change even if the outboard motor 9 is pivoted. In addition, it is possible to easily increase the area of the side surface apertures 30 without increasing the inner diameter of the steering shaft pipe 12. That is, this second embodiment has such an advantage that it is possible to reduce the inner diameter and the weight of the steering shaft pipe 12.

In the above description, air is introduced from the boat hull 1 to the engine compartment 5. However, it is also possible to pass various cables and conduits such as fuel supply pipe; mechanical and electrical cables, hydraulic conduits, etc. through the flexible duct 25 and the steering shaft pipe 12, without bending these cables and conduits whenever the outboard motor 9 is pivoted for steering operation. In addition, since these cables and conduits are passed through the duct 25 and the pipe 12 and further the duct 25 is located under the engine compartment 5 and between the outboard motor 9 and the transom 2 of the boat hull 1, it is possible to reduce trouble due to cable and conduit bending damage, while improving the external appearance.

As described above, in the air supply apparatus of the present invention, even if the outboard motor sinks into water periodically, it is possible to stably and continuously supply air into the engine compartment of the outboard motor. Further, the duct is not expanded or contracted during steering operation, it is possible to improve the durability of the duct. Furthermore, the duct is located below the engine compartment, the external appearance can be improved as compared with the prior-art outboard motor.

What is claimed is:

1. An air supply apparatus for an outboard motor provided with an engine compartment and a steering shaft and movably support near a transom of a boat hull, which comprises:

(a) a hollow steering shaft pipe positioned below said engine compartment and supported near the transom, formed with an inner hollow portion communicatable with the engine compartment; and (b) a flexible duct, connected between said hollow steering shaft pipe and the transom, for introducing air from inside the hull to the engine compartment through said flexible duct and said hollow steering shaft pipe.

2. An air supply apparatus for an outboard motor provided with an engine compartment and a steering shaft and movably supported near a transom of a boat hull, which comprises:

(a) a hollow steering shaft pipe fixedly supported near the transom and formed with an inner hollow portion communicatable with the engine compartment;

(b) upper and lower bearing, attached between upper and lower ends of said hollow steering shaft pipe, for pivotally supporting the steering shaft of the outboard motor; and (c) a flexible duct, connected between said hollow steering shaft pipe and the transom, for introducing air from inside the hull to the engine compartment through said flexible duct and said hollow steering shaft pipe.

3. The air supply apparatus of claim 2, which further comprises a cylindrical cover, attached to a bottom surface of the engine compartment coaxially with said hollow steering shaft pipe, for pivotally and slidably covering an upper side of said hollow steering shaft pipe, the inner hollow portion of said hollow steering shaft pipe communicating with the engine compartment through at least one opening formed in the upper bearing and covered by said cylindrical cover.

4. The air supply apparatus of claim 2, which further comprises a cylindrical cover, attached to a bottom surface of the engine compartment coaxially with said hollow steering shaft pipe, for pivotally and slidably covering an upper side of said hollow steering shaft pipe, the inner hollow portion of said hollow steering shaft pipe communicating with the engine compartment through at least one aperture formed in the upper side surface of said hollow steering shaft pipe and covered by said cylindrical cover.

5. An air supply apparatus for an outboard motor provided with an engine compartment and a steering shaft and liftably and tiltably supported near a transom of a boat hull, which comprises:

(a) a hollow steering shaft pipe fixedly supported near the transom and formed with an inner hollow portion;

(b) upper and lower bearings, attached between upper and lower ends of said hollow steering shaft pipe, for pivotally supporting the steering shaft of the outboard motor;

(c) a cylindrical cover, attached to a bottom surface of the engine compartment coaxially with said hollow steering shaft pipe, for pivotally and slidably covering an upper side of said hollow steering shaft pipe so that the inner hollow portion of said hollow steering shaft pipe communicates with the engine compartment; and (d) a flexible duct, connected between said hollow steering shaft pipe and the transom, for introducing air from inside the hull to the engine compartment through said flexible duct, said hollow steering shaft pipe and said cylindrical cover.

6. The air supply apparatus of claim 5, wherein the inner hollow portion communicates with the engine compartment through at least one opening formed in the upper bearing and covered by said cylindrical cover.

7. The air supply apparatus of claim 5, wherein the inner hollow portion communicates with the engine compartment through at least one aperture formed in the upper side surface of said hollow steering shaft pipe and covered by said cylindrical cover.

8. The air supply apparatus of claim 1, wherein said flexible duct is arranged between the outboard motor and the hull transom and below said engine compartment.

9. The air supply apparatus of claim 1, wherein said hollow steering shaft pipe extends below said engine compartment, and is positioned between said steering shaft and said propeller.

* * * * *